United States Patent [19]

Gundlach et al.

[11] 3,984,182

[45] Oct. 5, 1976

[54] PRETRANSFER CONDITIONING FOR ELECTROSTATIC PRINTING

[75] Inventors: Robert W. Gundlach, Victor; John E. Cranch, Penfield, both of N.Y.

[73] Assignee: Xerox Corporation, Stamford, Conn.

[22] Filed: Aug. 13, 1975

[21] Appl. No.: 604,513

Related U.S. Application Data

[63] Continuation of Ser. No. 440,409, Feb. 7, 1974, abandoned, which is a continuation of Ser. No. 312,149, Dec. 4, 1972.

[52] U.S. Cl. ..... 355/3 R; 250/326

[51] Int. Cl.[2] ..... G03G 15/22; G03G 15/16

[58] Field of Search ..... 355/3R, 3 TR, 3 TE, 355/3 TC; 250/326, 324, 325; 96/1 C; 317/4

[56] References Cited

UNITED STATES PATENTS

| | | | |
|---|---|---|---|
| 3,076,092 | 1/1963 | Molt | 250/326 |
| 3,307,034 | 2/1967 | Bean | 250/326 |
| 3,335,275 | 8/1967 | King | 250/326 |
| 3,357,400 | 12/1967 | Manghirmalani | 118/637 |
| 3,444,369 | 5/1969 | Malinaric | 250/326 |
| 3,492,476 | 1/1970 | Geimanos | 250/326 |
| 3,496,352 | 2/1970 | Jugle | 355/3 X |
| 3,557,368 | 1/1971 | Lono et al. | 250/326 |
| 3,620,616 | 11/1971 | Davidson | 355/3 |
| 3,689,146 | 9/1972 | Ilo et al. | 355/3 |

*Primary Examiner*—Joseph F. Peters, Jr.
*Assistant Examiner*—E. M. O'Connor
*Attorney, Agent, or Firm*—Earl T. Reichert

[57] ABSTRACT

An electrostatographic machine is provided with an A.C. corona discharge device having a D.C. bias impressed thereon which is applied to the photoconductive surface prior to the passage thereof through an image transfer zone, the A.C. charge being such as to aid both transfer efficiency and background suppression while the D.C. bias further enhances the efficiency of background removal.

4 Claims, 1 Drawing Figure

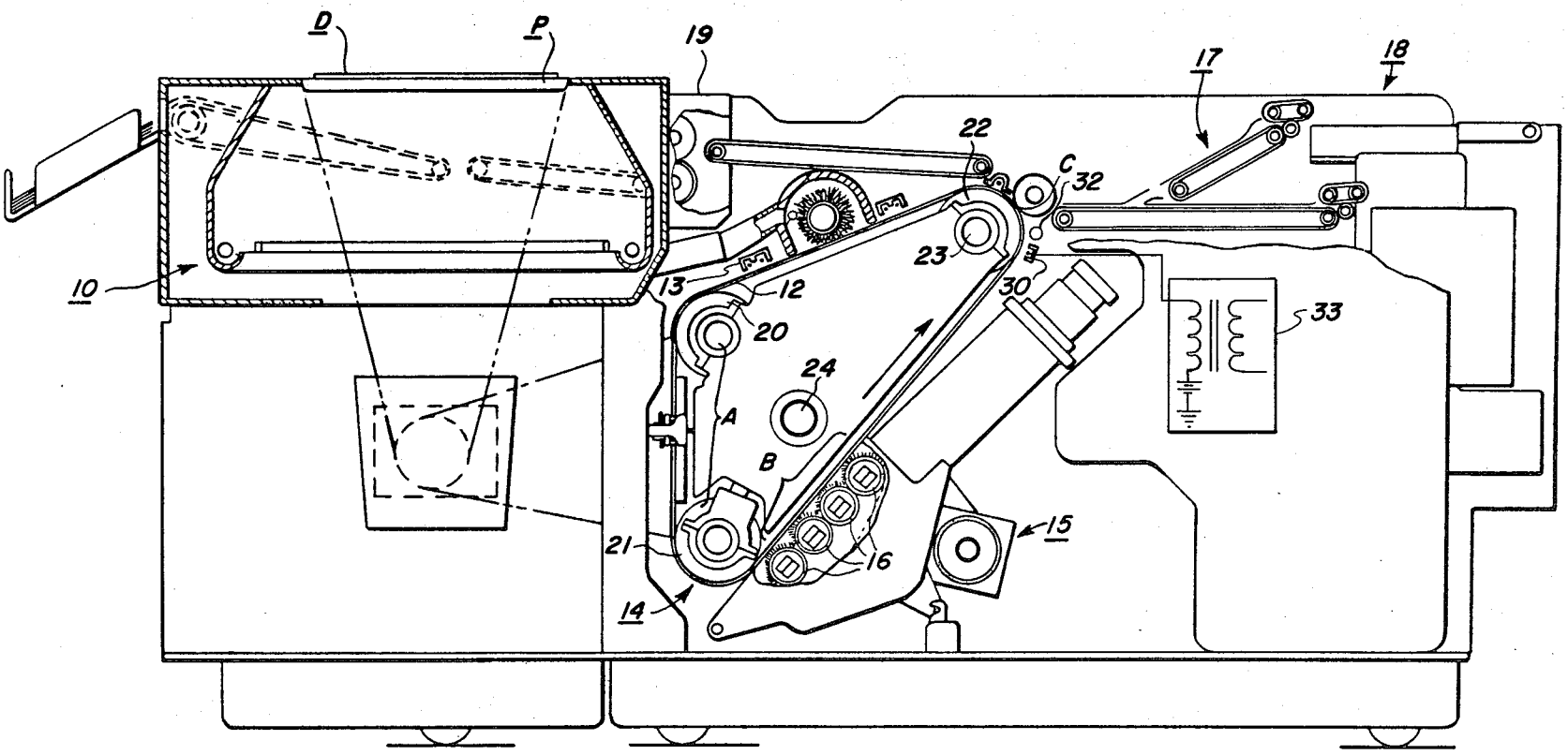
18
17
33
32
C
22
23
30
15
16
24
B
A
12
20
19
13
21
14
P
D
10

PRETRANSFER CONDITIONING FOR ELECTROSTATIC PRINTING

This is a continuation of U.S. application Ser. No. 440,409 filed Feb. 7, 1974, now abandoned, the latter being a continuation of U.S. application Ser. No. 312,149 filed Dec. 4, 1972.

This invention relates to electrostatography, and more particularly to an apparatus for enhancing the transferability of a developed latent image from a photoconductive surface to a receiving member, and for suppressing the transfer of background particles to the members.

In the known practice of xerography, a xerographic surface comprising a layer of photoconductive insulating material affixed to a conductive backing is used to support electrostatic images. In the usual method of carrying out the process, the xerographic surface is electrostatically charged uniformly over its surface and then exposed to a light pattern of the image being reproduced to thereby discharge the surface in the areas where light strikes the layer. The discharged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is greatest, the greatest amount of material is deposited; and where the field is least, little or no material is deposited. Thus, a powder image is produced in conformity with the light image of the copy being reproduced. The powder is subsequently transferred to a sheet of paper or other surface and suitably affixed to thereby form a permanent print.

The electrostatically attractable developing material commonly used in xerography consists of a pigmented resinous powder referred herein to as "toner" and a coarse granular material called "carrier." The carrier is coated with a material removed in the triboelectric series from the toner so that a charge is generated between the powder and the granular carrier upon mutual interaction. Such charge causes the powder to adhere to the carrier. The carrier, besides providing a charge to the toner, permits mechanical control so that the toner can readily be brought into contact with the exposed xerographic surface for the development of the surface. The powder particles are attracted to the electrostatic image from the granular material to produce a visible powdered image on the xerographic surface.

For high speed copying, the latest machine concept for copiers utilizes flash exposure of a document and the arrangement of a moving photoconductive material in the form of an endless belt which is continuously charged. In order to effectively develop the latent image produced in such a machine with the provision for solid area coverage, a developing system is employed which supplies toner particles in relatively large quantities.

In U.S. Pat. No. 2,965,756 to Vyverberg, for example, there is described an electrostatic machine employing a lamp for illuminating the photoconductive surface including a developed image prior to transfer of the image to an image receiving surface to discharge the residual charges on the non-image areas. In U.S. Pat. No. 3,357,400 to Manghirmalani, there is described an electrostatic apparatus utilizing an A.C. corotron which directs corona emissions to the back surface of an image receiving member prior to transfer of the developed image. In high speed machines, as hereinabove described, an effective method must be employed to provide readily transferred images of sharp contrast and having minimal background. In the above referred to U.S. Pat. No. 3,357,400, the electrical field created at a developed image prior to transfer is the result of a coaction with pure A.C. emissions. This, as the patentee states in that patent, achieves a net negative effect. While this effect may aid in a subsequent detacking of a sheet of paper, the prime concern of the patentee, it also causes more of the toner particles in background areas to transfer over to the sheet of paper during the image transfer step.

Therefore, the principal object of this invention is to provide an improved method and apparatus for enhancing the quality of the transferred image.

Another object of this invention is to provide an improved method and apparatus for enhancing the quality of the transferred image and to minimize the transfer of background particles.

These and other objects of the invention are obtained by exposing a selenium photoconductive surface after development of the latent image and prior to transfer of the developed image to a receiving member to a source of A.C. corona emissions having a positive D.C. bias impressed thereon. A source of actinic radiation may also be used to expose the image prior to transfer. Accordingly, image quality on the receiving member is enhanced by increasing transfer efficiency while inhibiting the transfer of background particles.

A better understanding of the present invention as well as other objects and further features thereof will become apparent upon consideration of the following detailed disclosure thereof, especially when taken with the accompanying drawing illustrating a schematic sectional view of an electrostatic reproduction machine embodying the present invention.

Referring to the drawing, a document D to be copied is placed upon a transparent support platen P fixedly arranged in an illumination assembly, generally indicated by the reference numeral 10, positioned at the left end of the machine. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same from a positive potential source by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During such movement of the belt 12, the reflected light image of such original document positioned on the platen is flashed on the surface of the belt to produce an electrostatic latent image thereon at exposure station A.

As the belt surface continues its movement, the electrostatic image passes through a developing station B in which there is positioned a developer assembly generally indicated by the reference numeral 15, and which provides development of the electrostatic image by means of multiple brushes 16 as the same moves through the development zone.

The developed electrostatic image is transported by the belt to a transfer station C whereat a sheet of copy paper is moved between a transfer roller and the belt at a speed in synchronism with the moving belt in order to accomplish transfer of the developed image solely by an electrical bias on the transfer roller. There is provided at this station a sheet transport mechanism generally indicated at 17 adapted to transport sheets of paper from a paper handling mechanism generally indicated by the reference numeral 18 to the developed image on the belt of the station C.

After the sheet is stripped from the belt 12, it is conveyed into a fuser assembly, generally indicated by the reference numeral 19, wherein the developed and transferred xerographic powder image on the sheet material is permanently affixed thereto. After fusing, the finished copy is discharged from the apparatus at a suitable point for collection externally of the apparatus.

Further details regarding the structure of the belt assembly 14 and its relationship with the machine and support therefor may be found in U.S. Pat. No. 3,730,623 assigned to the same assignee.

In accordance with the present invention, a pretransfer corotron 30, and a source of actinic electromagnetic radiation 32, such as a fluorescent lamp, are disposed transversely to the photoconductive belt 12 in an electrostatic copying machine at a position between the developer station B and the transfer station C to expose accordingly the photoconductive belt 12 across its width. The corotron 30 emits A.C. corona emissions upon activation by a energizing source 33 which decreases the range of charge differentials between the image and the non-image areas on the surface of the photoconductive belt 12. The power source 33 also supplies D.C. potential to the corotron in order to permit the corotron to emit D.C. biased A.C. corona upon the belt surface 12. Whether the D.C. bias is positive or negative depends upon the photoconductive material comprising the belt 12 and the polarity of the charge placed on the surface 12 prior to imaging or exposure. If the photoreceptor material is selenium wherein a uniform positive charge is applied for forming a latent image then the A.C. pretransfer corona is biased with a positive D.C. potential. If the photoreceptor material is such that negative charging is more receptive, such as some organic photoconductors, then the pretransfer A.C. corona would be biased with a negative D.C. potential. Typically, it has been found in practice that excellent results are attainable when using an A.C. input of 3000–7500 volts and a D.C. input of 300–1500 volts. The level of the D.C. component is such that a net positive charge is induced onto the photoconductive belt 12 that is at or above the background potential. The negatively charged toner particles on the background areas will preferably attract the positive charges produced by the positive D.C. bias thereby resulting is neutralized or positively charged particles which will not be attracted to sheets during the image transfer step. The charge level from the corotron is not so high as to substantially affect large toner deposits such as image areas, and transfer is not degraded thereby. The A.C. potential may be at line frequency, that is, at 60hz. However, if strobbing occurs such as may be the case for high speed machine processing, then higher frequency, preferably 600hz, should be utilized. The corotron 30 and the fluorescent lamp 32 are disposed so that the photoconductive surface of the moving belt 12 is exposed first to A.C. corona emissions and subsequently to actinic radiation. The fluorescent lamp 32 is activated by a conventional energizing source and is of an intensity sufficient to discharge not only the residual charges on the non-image areas of the photoconductive surface but also to discharge the photoconductive surface beneath the image areas.

While the instant invention as to its objects and advantages has been described herein as carried in specific embodiments thereof, it is not desired to be limited thereby; but it is intended to cover the invention broadly within the scope of the appended claims.

What is claimed is:

1. In xerographic processing apparatus of the type having a charging station to deposit an electrostatic charge on a photoconductive surface, an exposure station adapted to dissipate the charge in a patterned configuration of image and non-image areas corresponding to the image to be reproduced, a development station at which a xerographic developing material is adapted to be moved into contact with the photoconductive surface to thereby deposit charged toner particles on the photoconductive surface in a configuration corresponding to the image to be reproduced and unavoidably deposit a small quantity of said toner particles on the non-image area, and a transfer station adapted to retransfer toner adhering on the photoconductive surface to a backing material, the improvement comprising:

a corona discharge device positioned between the development station and the transfer station, and means for impressing an AC potential having a DC electrical bias on the discharge device, the DC bias being of a magnitude sufficient to deposit a net charge onto the photoconductive surface, which net charge is sufficient to neutralize the toner particles on the non-image area.

2. In xerographic processing apparatus of the type having a charging station to deposit an electrostatic charge on a photoconductive surface, an exposure station adapted to dissipate the charge in a patterned configuration of image and non-image areas corresponding to the image to be reproduced, a development station at which a xerographic developing machine is adapted to be moved into contact with the photoconductive surface to thereby deposit charged toner particles on the photoconductive surface in a configuration corresponding to the image to be reproduced and unavoidably deposit a small quantity of said toner particles on the non-image area, and a transfer station adapted to transfer toner adhering to the photoconductive surface to a backing material, the improvement comprising:

a corona discharge device positioned between the development station and the transfer station, and means for impressing an AC potential having a DC electrical bias on the discharge device, the DC bias being of a magnitude sufficient to deposit a net charge onto the photoconductive surface, which net charge is sufficient to charge the toner particles on the non-image area to a polarity which is opposite from the polarity of the toner particles on the image areas.

3. In xerographic processing apparatus of the type having a charging station to deposit an electrostatic charge on a photoconductive surface, an exposure station adapted to dissipate the charge in a patterned configuration of image and non-image areas corresponding to the image to be reproduced a development station at which a xerographic developing material is adapted to be moved into contact with the photoconductive surface to thereby deposit charged toner particles on the photoconductive surface in a configuration corresponding to the image to be reproduced and unavoidably deposit a small quantity of said toner particles on the non-image areas, a transfer device and means for impressing a potential on the transfer device having a charge adapted to transfer toner adhering to the photoconductive surface to a backing material, the improvement comprising:

a corona discharge device positioned to influence the deposited charge toner particles before coming under the influence of the transfer device, means for impressing an AC potential on the discharge device for decreasing the charge differential between image and non-image areas and thereby enhance transfer efficiency, and means for impressing a DC bias on the discharge device with a magnitude and polarity to deposit a net charge onto the photoconductive surface sufficient to make toner particles on the non-image area less transferable at the transfer device.

4. In xerographic processing apparatus of the type having a charging station to deposit an electrostatic charge on a photoconductive surface, an exposure station adapted to dissipate the charge in patterned configuration of image and non-image areas corresponding to the image to be reproduced, a development station at which a xerographic developing material is adapted to be moved into contact with the photoconductive surface to thereby deposit charged toner particles on the photoconductive surface in a configuration corresponding to the image to be reproduced and unavoidably deposit a small quantity of said toner particles on the non-image area, and a transfer station adapted to transfer toner adhering to the photoconductive surface to a backing material, the improvement comprising:

a corona discharge device positioned between the development station and the transfer station, and means for impressing an AC potential and a DC bias on the discharge device which enhances the transferability of toner particles in the image areas while simultaneously diminishing the transferability of toner particles in the non-image area.

* * * * *